US007091458B2

(12) United States Patent
Lee et al.

(10) Patent No.: US 7,091,458 B2
(45) Date of Patent: Aug. 15, 2006

(54) DOOR ASSEMBLY FOR MICROWAVE OVEN

(75) Inventors: Sang Ryul Lee, Masan-si (KR); Duck Gil Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 184 days.

(21) Appl. No.: 10/779,758

(22) Filed: Feb. 18, 2004

(65) Prior Publication Data

US 2004/0182856 A1 Sep. 23, 2004

(30) Foreign Application Priority Data

Mar. 19, 2003 (KR) ..... 10-2003-0017195
Mar. 25, 2003 (KR) ..... 10-2003-0018449

(51) Int. Cl.
*H05B 1/02* (2006.01)

(52) U.S. Cl. ..... 219/739; 219/722; 219/494; 219/414; 292/52; 292/53; 292/DIG. 69

(58) Field of Classification Search ..... 219/739, 219/722, 723, 724, 494, 412–414; 292/53, 292/44, 52, DIG. 69
See application file for complete search history.

(56) References Cited

U.S. PATENT DOCUMENTS 4,288,118 A * 9/1981 Ohkado ..... 292/201
4,450,335 A * 5/1984 Shimizu et al. ..... 219/723

FOREIGN PATENT DOCUMENTS

CN 88102377 11/1988
KR 1020000009289 2/2000

* cited by examiner

*Primary Examiner*—Mark Paschall
(74) *Attorney, Agent, or Firm*—Fleshner & Kim, LLP

(57) ABSTRACT

A door assembly for a microwave oven is provided. The door assembly includes a door panel at one side of the door, with a push bar and a latch each projecting toward a body portion of the microwave oven. A latch board including levers each rotatably coupled thereto contact either the latch or the push bar to operate switches which contact the levers. The door assembly provides a simple and convenient assembly structure for a door of a microwave oven.

30 Claims, 14 Drawing Sheets

DOOR ASSEMBLY FOR MICROWAVE OVEN

This application claims the benefit of the Korean Application Nos. P2003-0017195 filed on Mar. 19, 2003, and P2003-0018449 filed on Mar. 25, 2003, which are hereby incorporated by reference.

BACKGROUND OF THE INVENTION

1. Field of the Invention

The present invention relates to microwave ovens, and more particularly, to a door assembly for a microwave oven, having an improved structure.

2. Background of the Related Art

In general, the microwave oven (MWO) cooks food with intermolecular friction heat generated when molecular array of food is disturbed by a high frequency wave (approx. 2,450 MHz).

FIG. 1 illustrates a perspective view of a related art microwave oven.

Referring to FIG. 1, the related art microwave oven is provided with a body 10, an inner case 20, and an outfit chamber.

The body 10 is provided with a front case 11, an outer case 12, and a frame 13. The inner case 20 is provided inside of the body 10 for holding the food therein. The front case 11 is in a front part of the microwave oven, with a door 14 at one side thereof for opening/closing a front part of the inner case 20. The outer case 12 covers top and side surfaces of the microwave oven, with front edges thereof fastened to the front case 11.

The frame 13 covers a bottom and rear surfaces of the body 10, to protect the inner case 20 and the outfit chamber 30 from an external environment together with the outer case 12 and the front case 11.

In the meantime, the outfit chamber is formed on a side of the inner case 20 for providing various electric components thereto, including a magnetron 31, a high voltage transformer 32, and a fan 33.

The magnetron 31 provides a microwave to an inside of the inner case 20 for heating food. The high voltage transformer 32 provides a high voltage power to the magnetron 31. The fan 33 blows air into an inside of the body 10, for cooling various electric components.

In the meantime, there are brackets 15 fixed to a front surface of the frame 13, and the door 14 rotatably fixed to the brackets 15 opens/closes a front surface of the inner case 20. As described later, when the door 14 is closing, a latch on a door panel 141 pushes a lever on a latch board in the body 10, to operate a switch.

FIG. 2 illustrates a side view of a latch board in a related art microwave oven, and FIG. 3 illustrates a diagram showing operation of an actuator 'A' of a switch 'S' when the latch 142 of the door is inserted into a latch board 101. The frame 13 is on a front surface of the inner case 20, and the latch board 101 is on the frame 13.

The latch board 101 has three levers L1, L2, and L3, and 3~5 switches 'S' fitted therein. The switches 'S' include a first safety switch S1, a second safety switch S2, and a monitor switch S3.

Referring to FIG. 2, the first safety switch 'S1' is in a lower part of the latch board 101, the monitor switch 'S3' is in a central part, and the second safety switch 'S2' in an upper part. Each of the switches 'S' is fastened to the latch board 101 with two fastening pins 'P' and a hook 'H'.

There are two holes in a diagonal direction of each of the switches 'S'. After the fastening pins 'P' are aligned with the holes, the switches 'S' are pressed down, to insert the switch 'S' into the hook 'H' and fasten the switch 'S'.

A related art door latch structure will be described.

Referring to FIG. 2, there are latch inlets 103 in a front part of the latch board 101 for inserting the latch 142. An upper latch inlet 103 has a sloped surface 104 for guiding an upper latch 142*a* to upward.

Referring to FIG. 3, the upper latch 142*a* is engaged with one end of the first lever L1 as the upper latch 142*a* moves up along the sloped surface 104 and drops at an end of the sloped surface 104. In this instance, the upper latch 142*a* pushes the first lever L1.

In the meantime, a lower latch 142*b* is inserted into a lower latch inlet 103. In this instance, the lower latch 142*b* pushes both one end of the second lever L2 and one end of the third lever L3 below the second lever L2.

In this instance, other end of the first lever L1 pushes an actuator A2 of the second safety switch S2, and the second lever L2 and the third lever L3 push the monitor switch S3 and actuators A1 and A3 of the first safety switch S1, respectively.

According to this, the first lever L1 operates the second safety switch S2, the second lever L2 operates the monitor switch S3, and the third lever L3 operates the first safety switch S1.

In the meantime, when the door is opened, a door handle is operated, to lift the latches 142*a* upward, so that the latches 142 are pulled out of the latch inlets 103. Thereafter, as the levers L, respectively turned by the latches 142, are restored by the springs 107 respectively, the actuators 'A' on the switches 'S' are released, respectively.

A related art assembly structure of the door will be described. FIG. 4 illustrates fitting of the pin to the related art door, and FIG. 5 illustrates fastening of the pin.

Referring to FIG. 4, there are horizontal members 50 on an upper part and a lower part of an inside of the door 14. The horizontal member 50 is extended form an edge of the door 14. The horizontal member 50 has a pin 55 fastened thereto for serving as a rotation shaft of the door 14.

Referring to FIG. 5, the horizontal member 50 has a hole 51 formed therein, for inserting the pin 55 therein. The pin 55 has a flange 56 at a middle part thereof.

According to this, when the pin 55 is inserted into the hole 51 by a predetermined length, the flange 56 is held by a lower surface of the horizontal member 50, when an extension 57 from a rear end of the pin 55 is projected by a length beyond the horizontal member 50. The extension 57 is flattened by caulking.

Thus, as the horizontal member 50 is clamped between the flange 56 and the extension 57, the pin 55 is fastened to one side of the horizontal member 50.

In the meantime, as shown in FIG. 1, the brackets 15 are on one side of the frame 13. The bracket 15 has a hole 15*a* in one end part thereof, to which the pin 55 is inserted. Thus, the door 14 is rotatably mounted on the frame 13. The pin 55 serves as a rotation shaft of the door.

As described, the related art door latch board has the following problems.

First, the many levers and springs required as many as a number of switches increase a number of components, and results in a complicated assembly process.

Second, the holes, fastening pins, and hooks required for fastening the switches to the latch board requires complicated switching fastening process.

Third, since the pin fitted to the door is a separate component, a fitting process increases, and the extension of the pin is damaged in the caulking.

SUMMARY OF THE INVENTION

Accordingly, the present invention is directed to a door assembly for a microwave oven that substantially obviates one or more of the problems due to limitations and disadvantages of the related art.

An object of the present invention is to provide a door assembly for a microwave oven that has a simple and convenient assembly structure.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the door assembly for a microwave oven includes a door panel at one side of the door, having a push bar and a latch both projected from one side toward a body, and a latch board including levers each fitted rotatable at contact with the latch or the push bar, and switches each operable at contact with the lever.

At least one of the levers has at least three arms. The levers include a first lever for being brought into contact with the push bar, and a second lever for being brought into contact with the latch.

The second lever includes a third arm for being brought into contact with the latch, and a second arm, and a first arm for operating the switches respectively when the third arm is pushed and rotated by the latch. The first lever includes a second arm for being brought into contact with the push bar, and a first arm for operating the switch when the second arm is pushed and rotated by the push bar.

The door panel is preferably formed as one unit with the door. The latch board includes a push bar hole and a latch hole for inserting the push bar and the latch, respectively.

The latch has a sloped surface at an end part for inserting the latch into the latch hole as the sloped surface slides the latch hole. The latch hole includes a projection on an inside edge for hooking the latch. The lever is held by an upper side of the projection.

The door assembly further includes a spring having one end hooked at a hook at one side of the latch, and the other end held in an upper part of the door panel. The spring provides a restoring force for rotating the latch, which pushes the arm of the lever.

Preferably, the switches are fitted on a front surface and a rear surface of the latch board in parallel. The latch board has a fastening pin and boss, and the switch has holes for inserting the fastening pin and the boss, for fastening the switch to the latch board with screw fastened to the boss.

The levers rotate to original positions when the levers are disengaged from the latch or the push bar. The latch board has stoppers for holding the levers at preset positions, respectively.

The levers are fitted to rotation shafts projected from the door panel respectively, and the levers fitted to the rotation shafts are held by hooks, respectively. The lever has a sloped surface at a part the lever is brought into contact with the hook in fitting the lever to the rotation shaft.

In other aspect of the present invention, there is provided a door assembly for a microwave oven including a door panel at one side of the door, having a push bar and a latch both projected from one side toward a body, and a latch board including levers each fitted rotatable at contact with the latch or the push bar, a board wall for dividing a front surface and a rear surface, and switches fitted on the front and rear surfaces of the board wall in parallel.

The board wall has pass through holes formed therein, and the levers have extensions rotatable along the pass through holes, respectively. The levers operate switches on the front surface respectively, and the extensions operate the switches on the rear surfaces respectively.

The switches include a first safety switch, a second safety switch, and a monitor switch, and switches are fitted parallel to, and on opposite side of the switches.

In another aspect of the present invention, there is provided a door assembly for a microwave oven including horizontal members each extended from an upper part, or a lower part of an edge of the door, pins each formed as one unit with one of the horizontal members, and brackets on a frame of the microwave oven, each having a hole for rotatably inserting the pin.

The pin is a projection from the horizontal member formed by pressing. The horizontal members are formed as one unit with the door.

In further aspect of the present invention, there is provided a door assembly for a microwave oven including a latch assembly including a door panel at one side of a door for the microwave oven, a push bar projected from the door panel toward a body, a latch rotatably fitted to the door panel spaced a distance away from the push bar, a spring having one end held at an upper part of the door panel, and the other end connected to the latch, and a fastening pin fastened through the door panel and the latch to serve as a rotation shaft of the latch, and a latch board including levers rotatable at contact with the latch and the push bar respectively, and switches operable at contact with the levers respectively.

The door assembly further includes a handle linked with the latch, and fitted rotatable around the fastening pin. The fastening pin has a head clamped between the door and the door panel.

The spring provides a restoring force for rotating the latch in one direction. The door assembly further includes a projection on one side part of the door panel for holding the latch such that the latch rotates no more than a desired angle.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Figure 6:
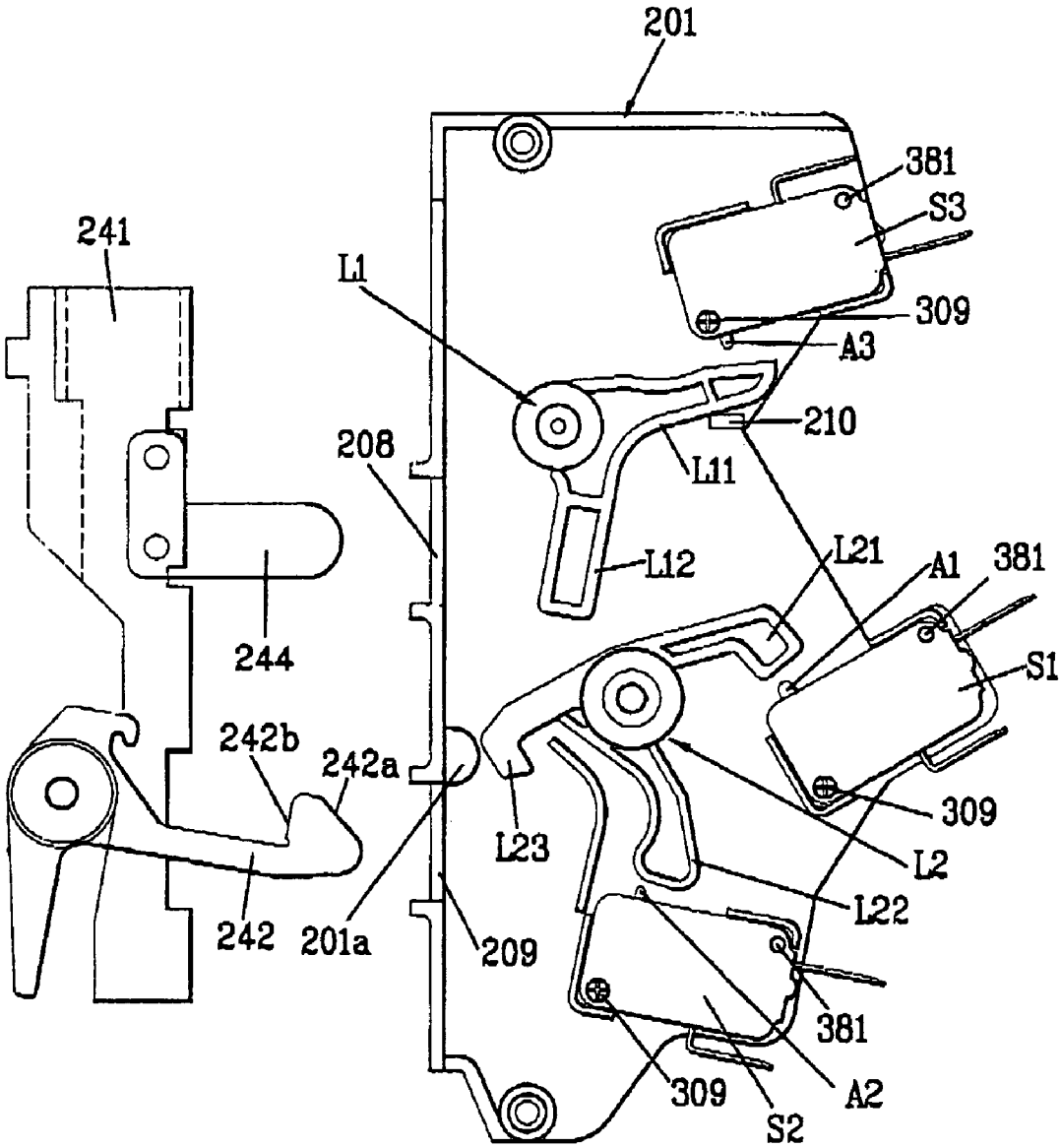
FIG. 6 illustrates a diagram showing latches and a latch board in a microwave oven in accordance with a preferred embodiment of the present invention.

Reference will now be made in detail to the preferred embodiments of the present invention, examples of which are illustrated in the accompanying drawings FIGS. 6~17. In describing the embodiments, same parts will be given the same names and reference symbols, and repetitive description of which will be omitted. FIG. 6 illustrates a diagram showing latches and a latch board in a microwave oven in accordance with a preferred embodiment of the present invention.

Figure 1:
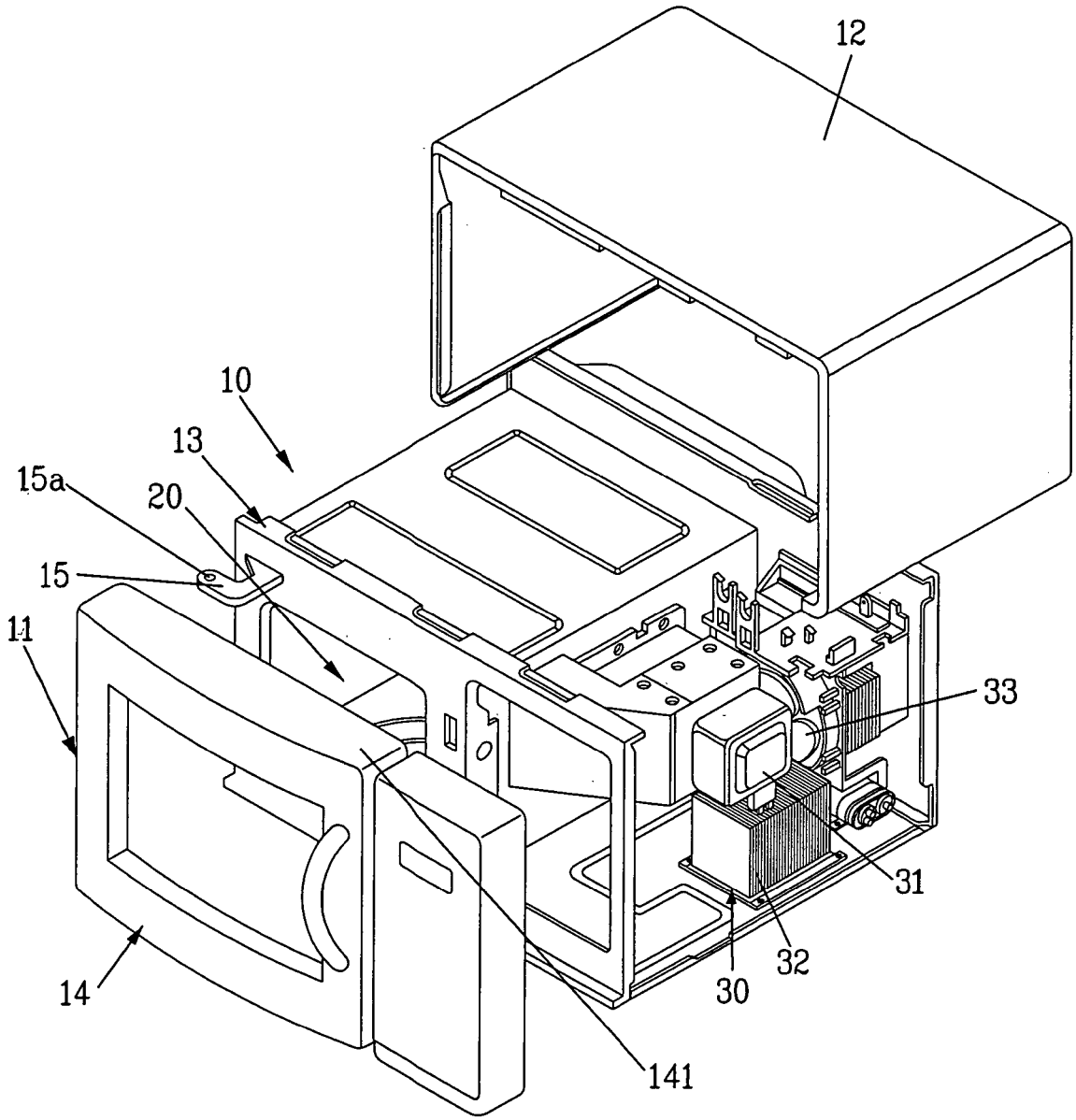
FIG. 1 Prior Art
FIG. 1 illustrates a perspective view of a related art microwave oven.
Figure 2:
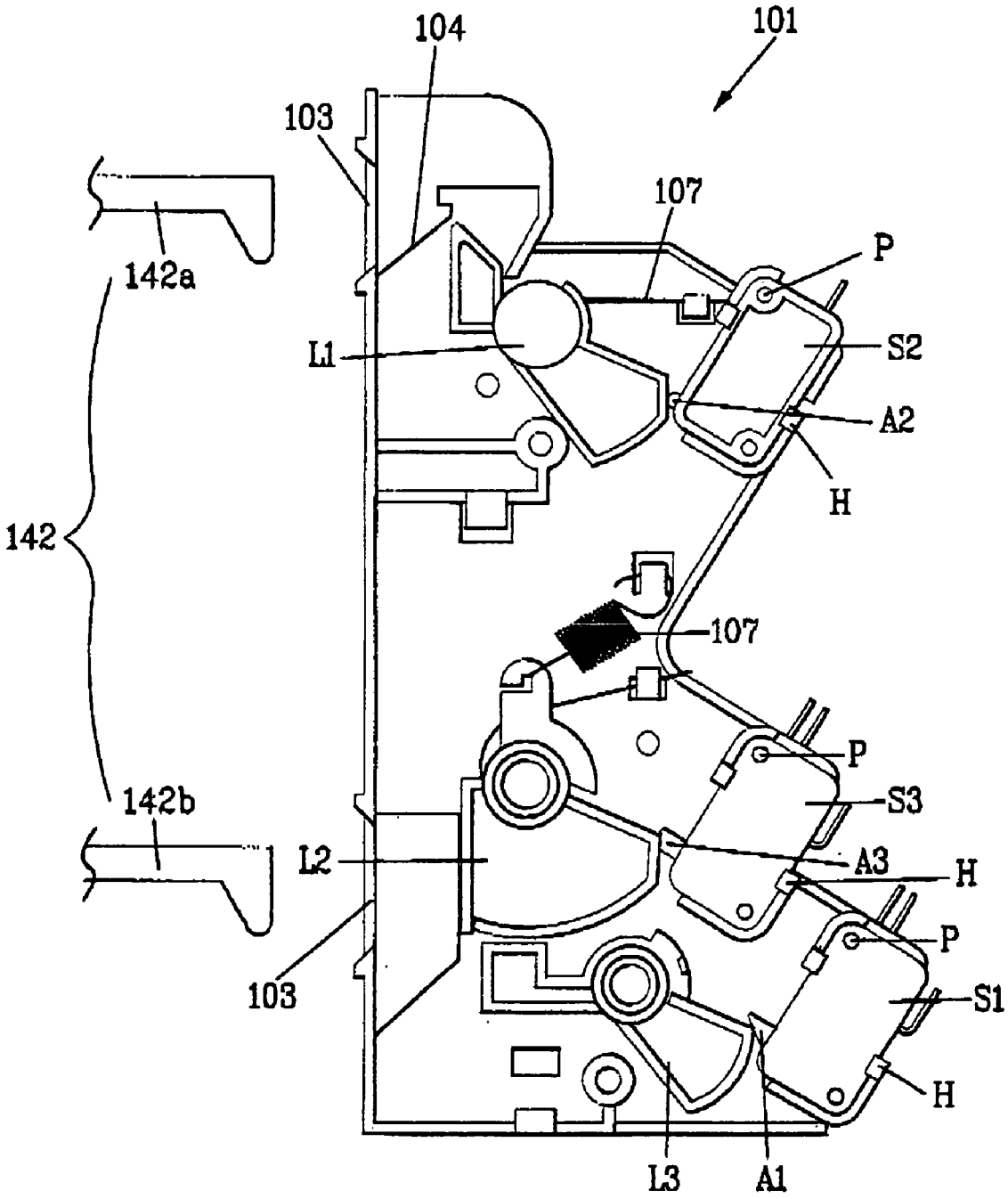
FIG. 2 Prior Art
FIG. 2 illustrates a side view of a latch board in a related art microwave oven.
Figure 3:
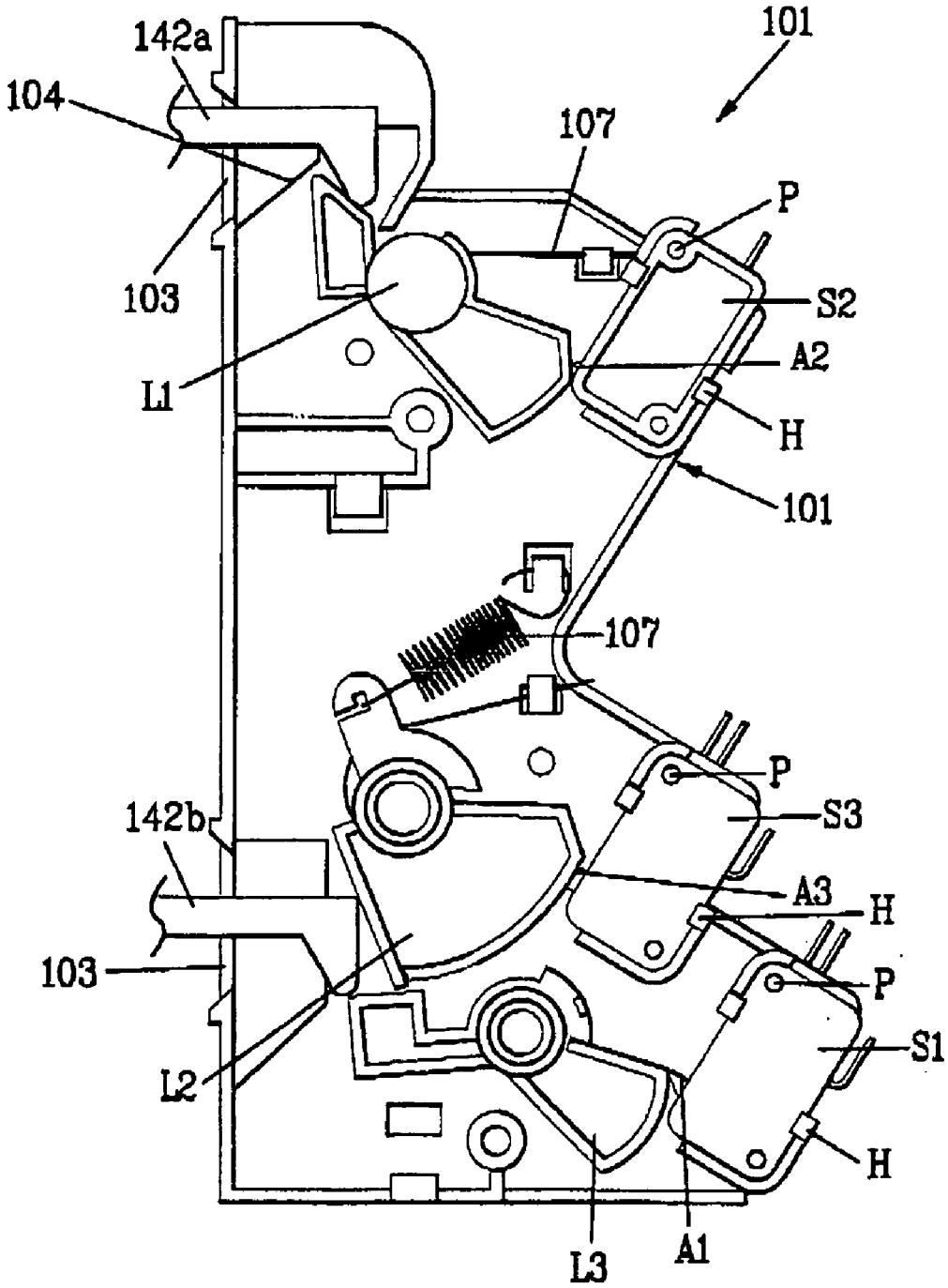
FIG. 3 Prior Art
FIG. 3 illustrates a diagram showing latches inserted in a related art latch board to operate actuators of switches.
Figure 4:
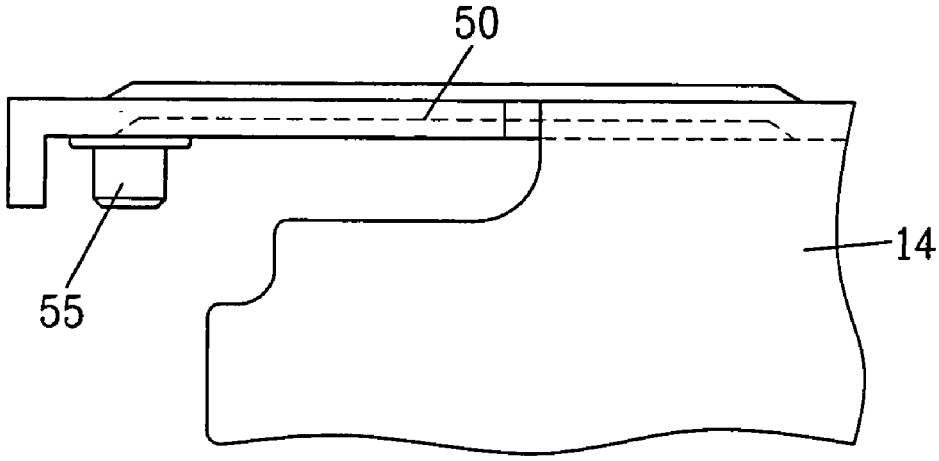
FIG. 4 Related Art
FIG. 4 illustrates a diagram showing a fastening structure of a pin to one side of a related art door.
Figure 5:
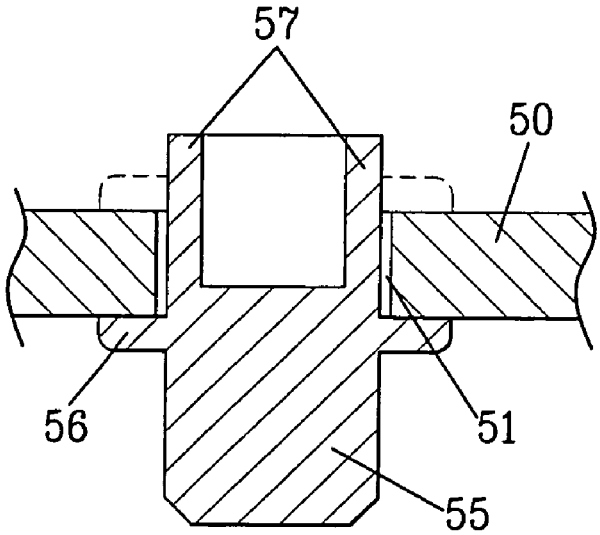
FIG. 5 Prior Art
FIG. 5 illustrates a diagram showing a related art pin fastening method.

Referring to FIG. 6, there are a latch board 201 provided to one side of a frame (reference numeral 13 in FIG. 1), and first and second levers L1 and L2 rotatably fitted to upper part and lower part of the latch board 201, respectively.

The first lever L1 has two arms, and the second lever L2 has three arms. There is a door panel 241 at one side of a door, having a push bar 244 and a latch 242 fitted thereto. The door panel 241 may be fabricated as one unit with the door.

The latch board 201 has a bar hole 208 and a latch hole 209. When the door is closed, the push bar 244 and the latch 242 are inserted into the bar hole 208 and the latch hole 209, respectively. In this instance, the push bar 244 pushes an arm of the first lever L1, and the latch 242 pushes an arm of the second lever L2.

In the meantime, the head part 242*a* of the latch 242 has a hook 242*b*, and the latch hole 209 has a projection 201*a* from an inside of an upper edge thereof. The hook 242*b* is hooked at the projection 201*a*.

Figure 7:
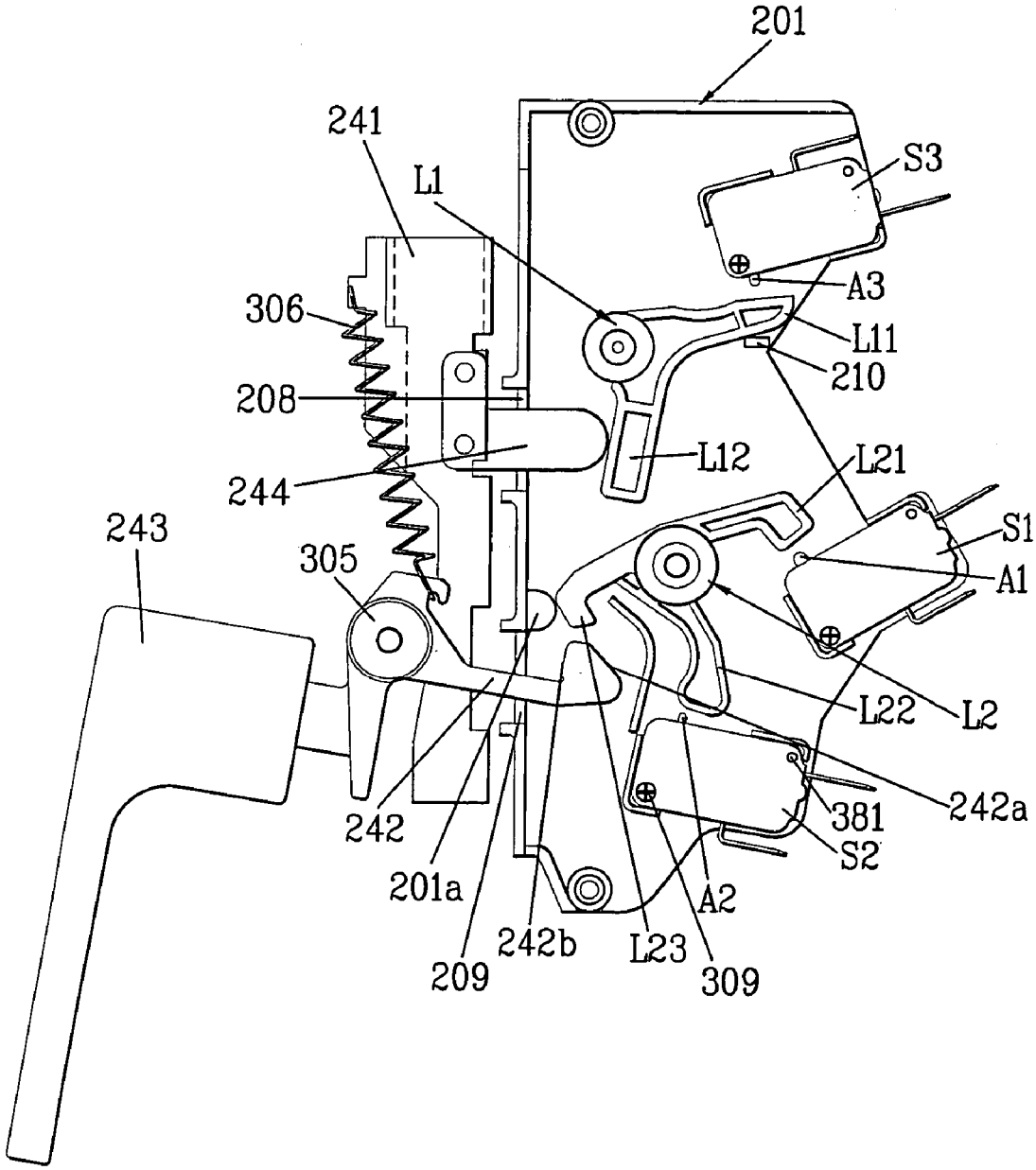
FIGS. 7 and 8 illustrate diagrams each showing operation between latches and a latch board following operation of a door handle of the present invention.
Figure 8:
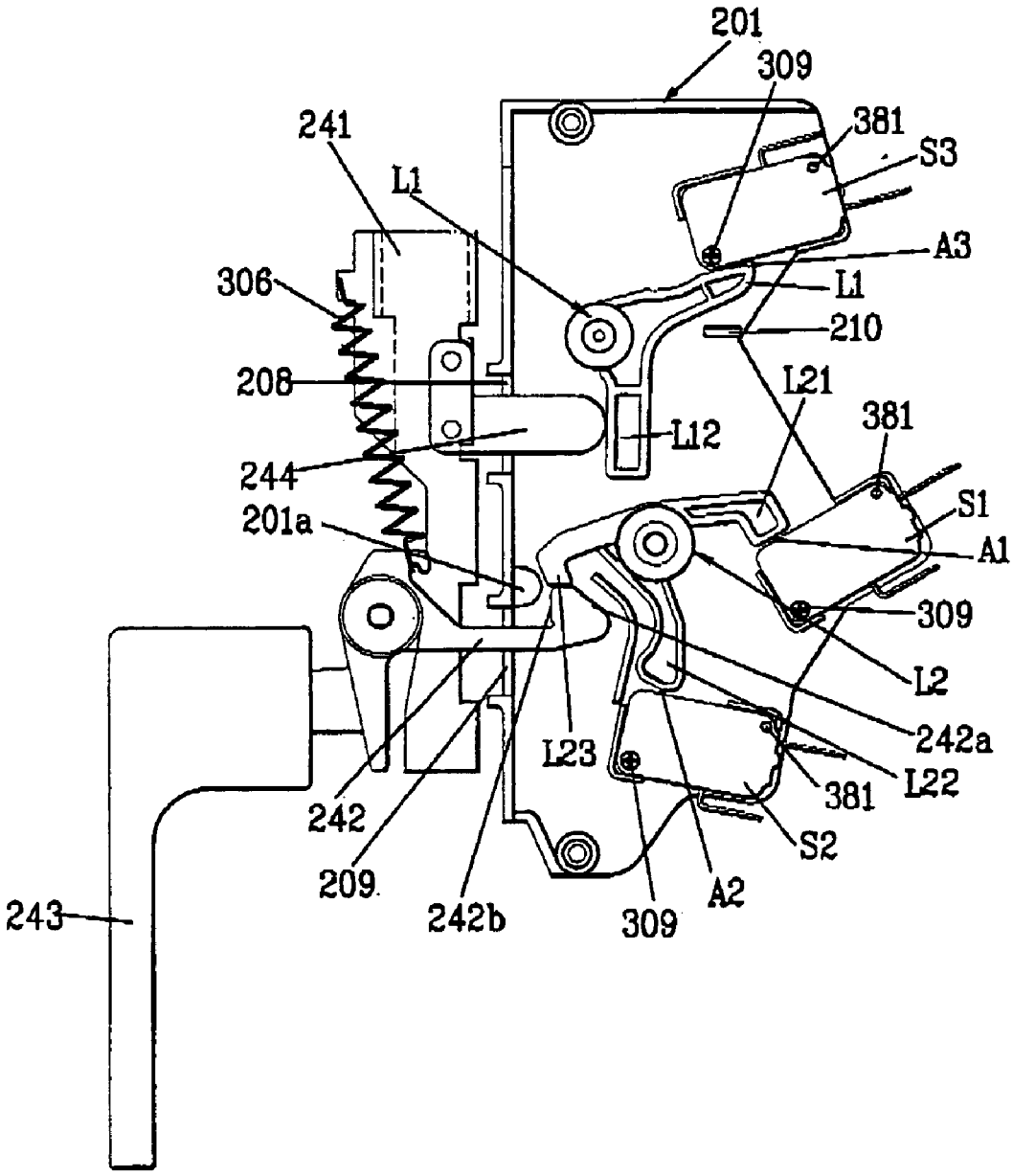

FIGS. 7 and 8 illustrate diagrams showing different states of engagement of the latch with the latch board following operation of the door handle when the door is closed.

Referring to FIG. 7, the latch 242 is fitted rotatable around a rotation shaft 305, and the rotation shaft 305 has a rear end having a door handle 243 fixed thereto. An upper side of the latch 242 and one side of the door panel 241 are connected with a spring 306. The door handle 243 is rotated in a clockwise direction in opening the door.

When the door handle 243 is rotated in the clockwise direction, the latch 242 also rotates in the clockwise direction, and disengaged from the projection 201*a*. In this instance, a restoring force is provided from the spring 306 to the latch 242 for rotating the latch 242 in a counter clockwise direction.

FIG. 8 illustrates a diagram showing engagement of the latch with the latch board when the door is closed.

Referring to FIG. 8, when the door is closed, the latch 242 is inserted in the latch hole 209 as a sloped surface of the latch head 242*a* slides along an edge of the latch hole 209, and rotates in the counter clockwise direction by the spring 306 until the hook 242*b* on the latch 242 is hooked at the projection again, when the door is locked.

The latch board 201 has three switches 'S' each of which is operable when an actuator thereon is pressed. The switches includes a monitor switch 'S3', a second safety switch 'S2', and a first safety switch 'S1'. The monitor switch 'S3' is in an upper part of the latch board 201, the second safety switch 'S2' is in a lower part the latch board 201, and the first safety switch 'S1' is in a central part the latch board 201. The actuator 'A3' of the monitor switch 'S3' is positioned adjacent to the arm of the first lever L1, and the actuators A1 and A2 of the first safety switch 'S1' and the second safety switch S2 are positioned adjacent to arms of the second lever L2, respectively.

The operation of the monitor switch 'S3' with the first lever 'L1' will be described.

Referring to FIG. 8, when the door on the microwave oven is closed, the push bar 244 inserted through the bar hole 208 pushes a lower arm L12 of the first lever L1 downward, when the first lever L1 rotates in the counter clockwise direction until an upper arm L11 thereof presses an actuator 'A3' on a bottom of the monitor switch 'S3'.

In the meantime, referring to FIG. 6, when the door is opened, the push bar 244 moves back, to release a force pushing the lower arm L12 of the first lever L1. According to this, the first lever L1 rotates in a clockwise direction by gravity of the upper arm L11. After rotated at a certain angle, the upper arm L11 is held at a stopper 210 thereunder, to hold the first lever L1 in a substantial 'r' position.

Next, the operation of the first safety switch 'S1' and the second switch 'S2' with the second lever 'L2' will be described.

Referring to FIG. 6, in opening the door, arms of the second lever L2 move away from the actuators respectively. In this instance, the first arm L21 positions over the actuator 'A1' of the first safety switch 'S1', the second arm L22 positions over the actuator 'A2' of the second safety switch 'S2, and the third arm L23 is held at the projection 201*a* on one side of the latch hole 209.

In the meantime, referring to FIG. 8, in closing the door, the latch 242 is inserted through the latch hole 209. Then, the latch 242 is hooked at the projection 201*a* by the restoring force provided from the spring 306.

In this instance, the latch head 242*a* pushes the third arm L23 to rotate in the clockwise direction. The first arm L21 presses down the actuator 'A1' of the first safety switch S1, and the second arm L22 presses down the actuator 'A2' of the second safety switch S2.

According to this, the latch board 201 in accordance with a first preferred embodiment of the present invention can operate three switches S1, S2, and S3 only with two levers L1, and L2. Moreover, since the levers L1 and L2 are restored by own gravity, respectively, no separate spring is required.

Structures for fitting the monitor switch S3, the first safety switch 'S1', and the second safety switch 'S2' to the latch board 201 respectively will be described.

Each of the switches has two holes in a diagonal direction, and the latch board 201 has fastening pins 381 and bosses (not shown) at positions corresponding to positions of the holes. The fastening pins 381 and the bosses are inserted in the holes in the switches, respectively. By fastening screw 309 to the bosses, the switch 'S' is fastened to the latch board 201.

The switches 'S' may be fastened by two in parallel, when the switches 'S' are fastened to the latch board 201 with screws 309 and fastening pin as long as a width of the switches overlapped in parallel.

Figure 9:
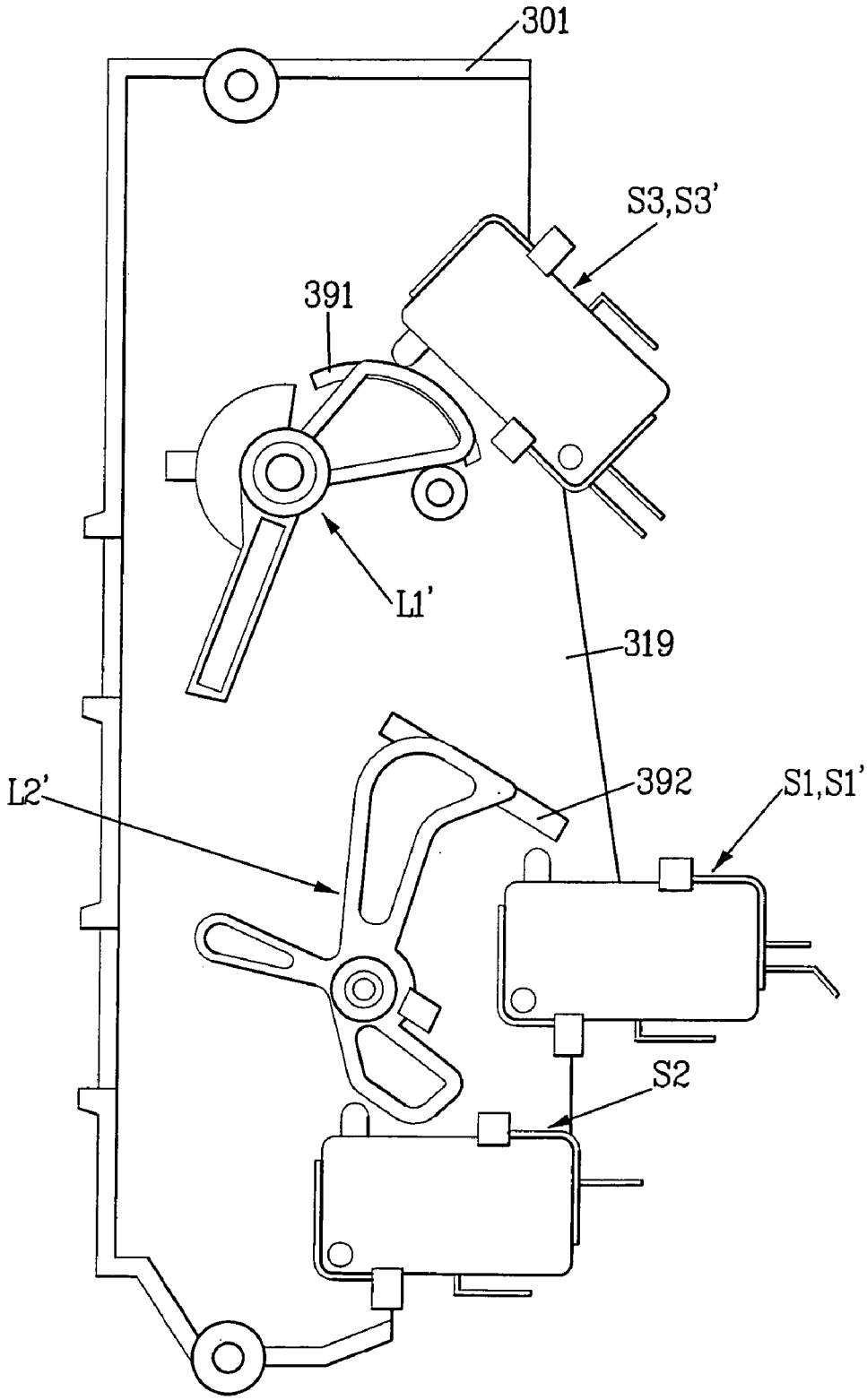
FIG. 9 illustrates a diagram showing a latch board in accordance with a second preferred embodiment of the present invention.
Figure 10:
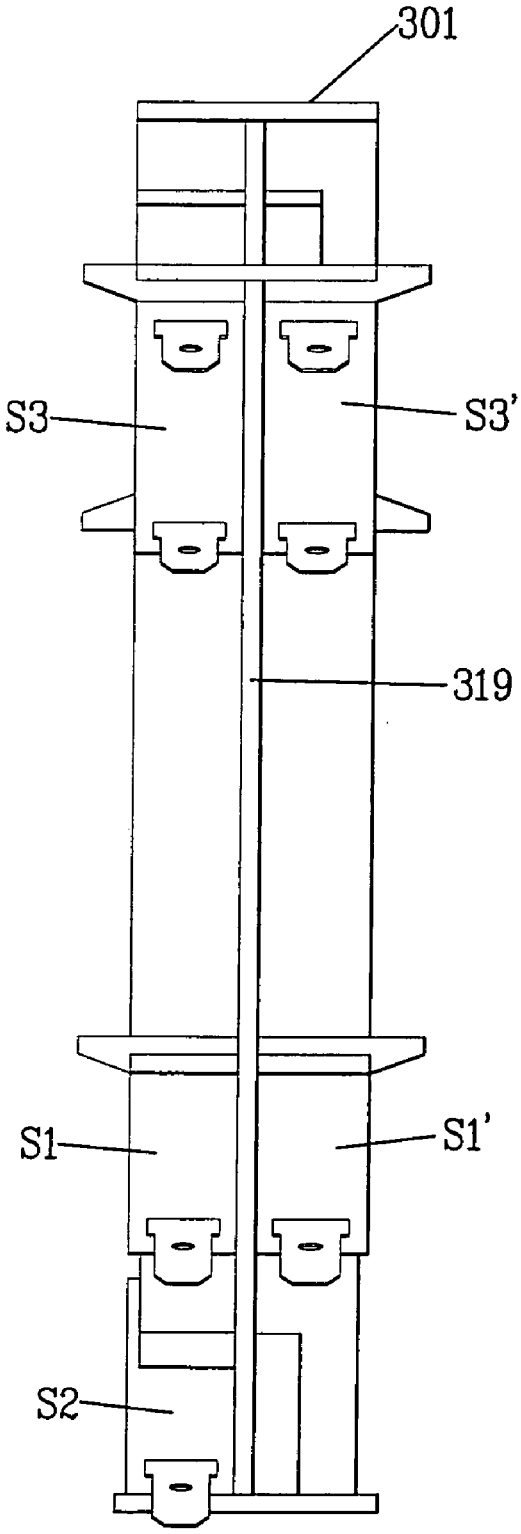
FIG. 10 illustrates a side view of a latch board in accordance with a second preferred embodiment of the present invention.

FIG. 9 illustrates a side section of a latch board in accordance with a second preferred embodiment of the present invention, and FIG. 10 illustrates a rear view of a latch board in accordance with a second preferred embodiment of the present invention.

Referring to FIGS. 9 and 10, the latch board 301 is divided into a front surface part and a rear surface part by a board wall 319. The front surface part has a first lever L1, a second lever L2, a monitor switch S3, a first safety switch S1, and a second safety switch S2 fitted thereto, and the rear surface part has the other monitor switch S3' and the other first safety switch S1'. The other monitor switch S3' and the other first safety switch S1' may be substituted with switches having different functions, respectively. For simultaneous operation of the one pair of switches fitted in parallel in front and rear of the board wall 319, the levers 'L' are passed through the board wall 319.

Figure 11:
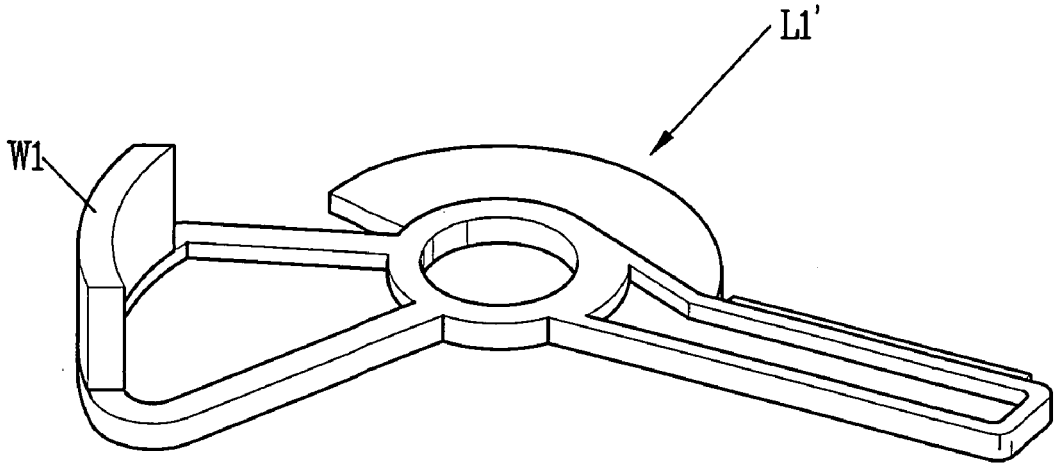
FIGS. 11 and 12 illustrate perspective views showing a first lever and a second lever to be fitted to a latch board in accordance with a second preferred embodiment of the present invention, respectively.
Figure 12:
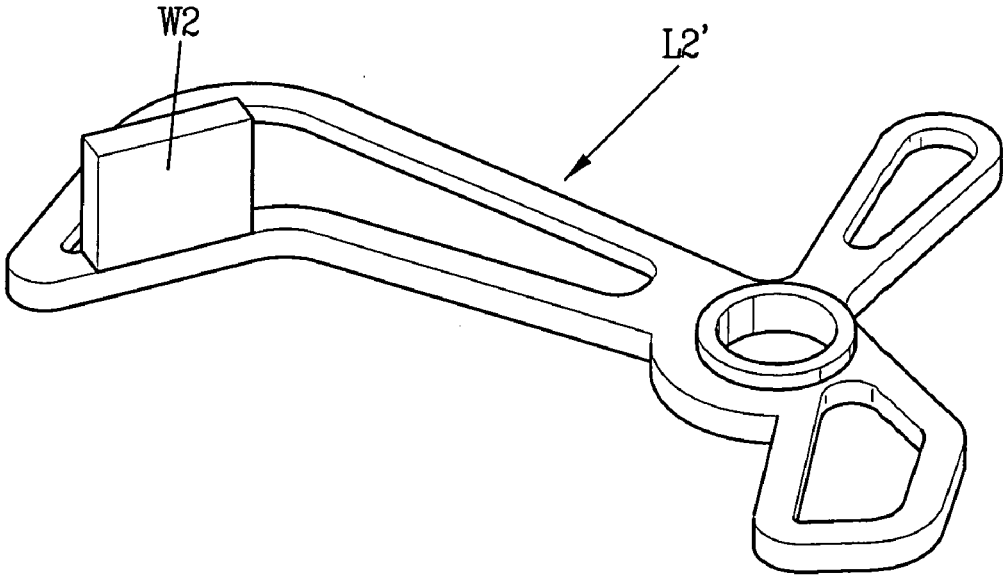

FIGS. 11 and 12 illustrate perspective views showing a first lever L1' and a second lever 'L2' to be fitted to a latch board in accordance with a second preferred embodiment of the present invention, respectively.

As shown in the drawings, the first lever L1' and the second lever L2' have extensions W1 and W2 passed through the board wall 319 respectively, and the latch board 301 has lever pass through holes 391, and 392 the extensions W1 and W2 pass therethrough. Actuators of the switches fitted parallel to each other are pressed at the same time with the extensions W1, and W2.

For an example, two monitor switches S3, and S3', and actuators A3, and A3' thereof are fitted in parallel respectively, and the extension W1 pass through the lever pass through hole 391 so that the first lever L1' presses the two actuators at the same time. When the push bar 244 presses the first lever L1', the extension W1 from the upper arm is rotated. According to this, the actuators A3, and A3' of the monitor switches S3 and S3' positioned in front and rear surfaces of the latch board 301 are pressed at the same time with the upper arm and the extension of the first lever L1'.

Likewise, the extension W2 from the second lever L2' also passes through the lever pass through hole 392 in the latch board 301. When the latch 242 presses the second lever L2', the extension W2 from the second lever L2' rotates. According to this, the actuators A1, and A2 of the first safety switches S1, and S1' positioned on the front and rear surfaces of the latch board 301 are pressed at the same time by the arm and the extension W2 of the second lever L2'.

Figure 13:
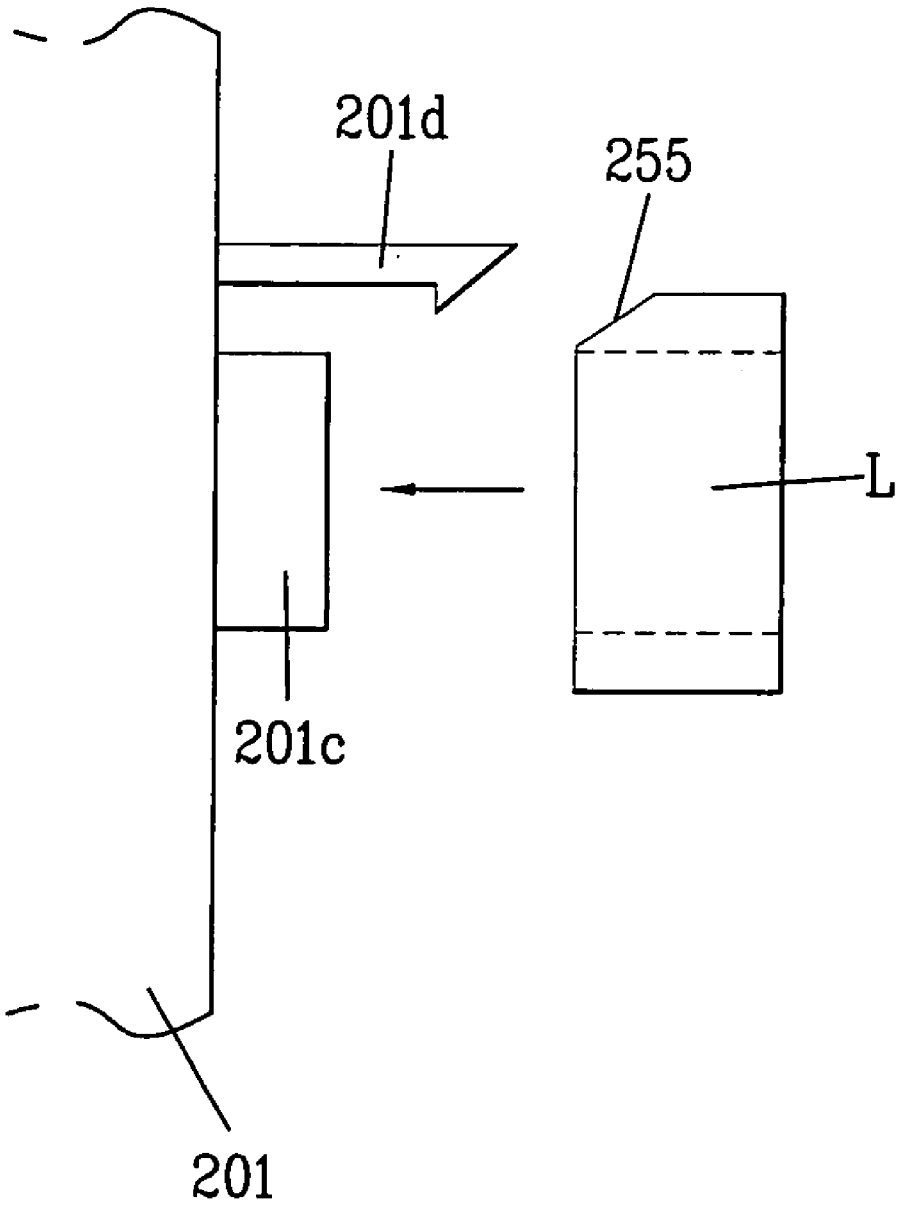
FIG. 13 illustrates a structure employed in each of embodiments for holding a lever on a latch board with a hook.

FIG. 13 illustrates a structure employed in each of embodiments for holding a lever L1, L1', L2, or L2' on a board wall of a latch board.

Referring to FIG. 13, the lever L is rotatably fitted to a rotation shaft 201*c* of a latch board 201. The lever L is held with a hook 201*d* after the lever L is inserted in the rotation shaft 201*c* for preventing break away of the lever L from the rotation shaft 201*c*.

When the lever L is inserted onto the rotation shaft 201*c*, the hook 201*d* deforms elastically, and after insertion of the lever L is finished, the hook 201*d* is restored, to hold an upper part of the lever L. For preventing deformation or breakage of the hook 201*d* in contact with the lever L, a sloped surface 255 is formed at the lever L in contact with the hook 201*d*. That is, since a head of the hook 201*d* slides along the sloped surface 255 when the hook 201*d* fastens the lever L, the lever L can be fitted to the latch board more stably without any damage to the lever L or the hook 201*d*.

Moreover, it is preferable that the rotation shaft 201*c* and the hook 201*d* are formed as one unit with the latch board 201 for simplifying an assembly structure of the latch board 201.

Figure 14:
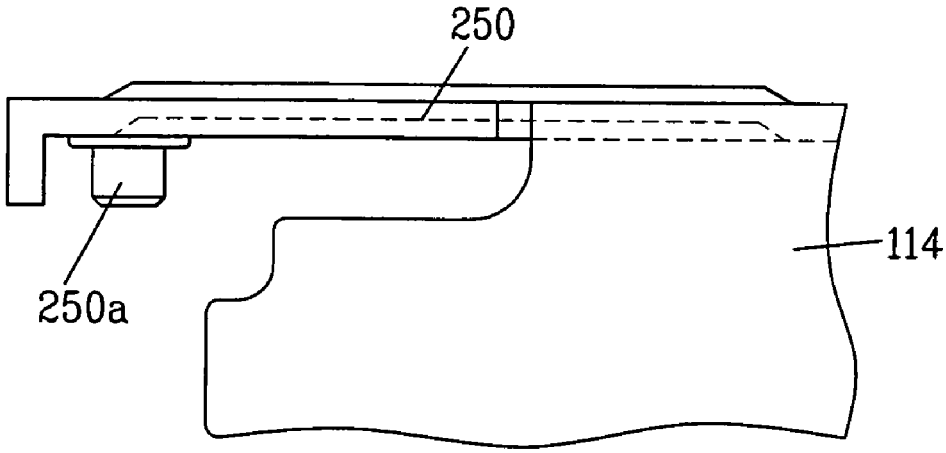
FIG. 14 illustrates a diagram of a pin formed at one side of a door in accordance with a preferred embodiment of the present invention.

In the meantime, a mounting structure of the door on the microwave oven of the present invention will be described. FIG. 14 illustrates a diagram of a pin formed at one side of a door as one unit with the door in accordance with a preferred embodiment of the present invention, and FIG. 15 illustrates a section of the pin.

Referring to FIG. 14, there is a horizontal member 250 on an inside surface of the door 114. The horizontal member 250 has a pin 250*a* formed as one unit with the horizontal member 250 for serving as a rotation shaft of the door 114. Also, it is preferable that the horizontal member 250 is formed as one unit with the door 114.

Figure 15:
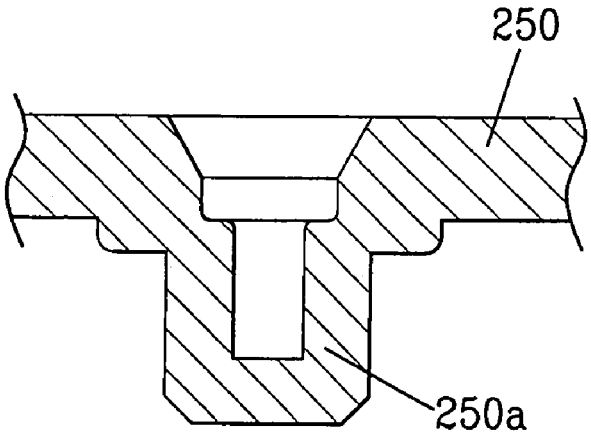
FIG. 15 illustrates a section of a pin in accordance with a preferred embodiment of the present invention.

Referring to FIG. 15, the pin 250*a* is formed as one unit with the horizontal member 250 at one side part of the horizontal member by pressing. Therefore, it is preferable that the horizontal member 250 of the door is formed of a metal for easy pressing. Since the pin 250*a* is formed as one unit with the horizontal member 250, fitting of the pin 250*a* is easy and damage to the pin 250*a* is prevented in comparison to a case the pin is fitted as a separate component.

In this instance, as the pin 250*a* is inserted to the hole 15*a* at an end part of the bracket 15, the door 114 is rotatably mounted on the frame 13.

Figure 16:
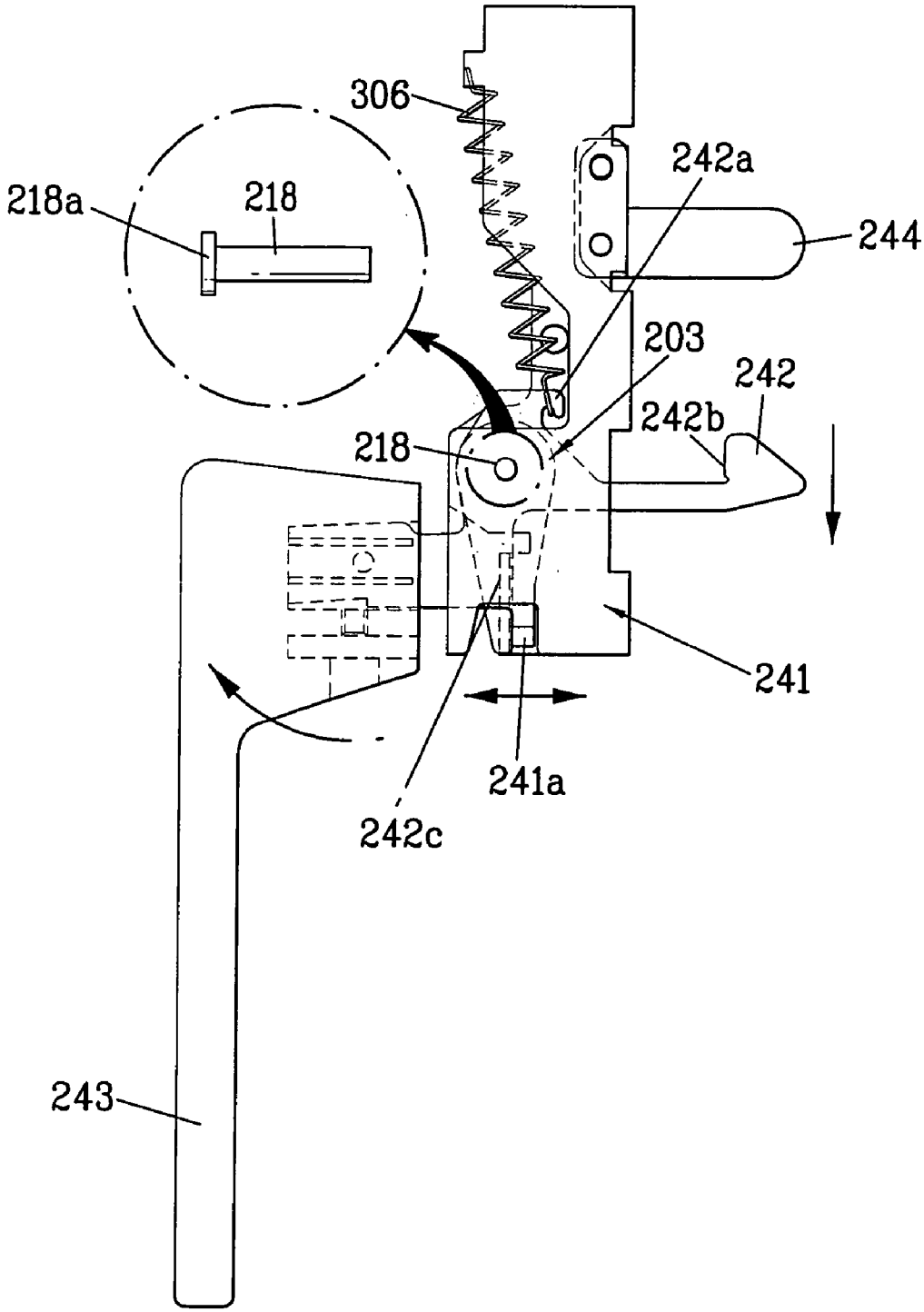
FIG. 16 illustrates a side view of a latch assembly in accordance with a preferred embodiment of the present invention.
Figure 17:
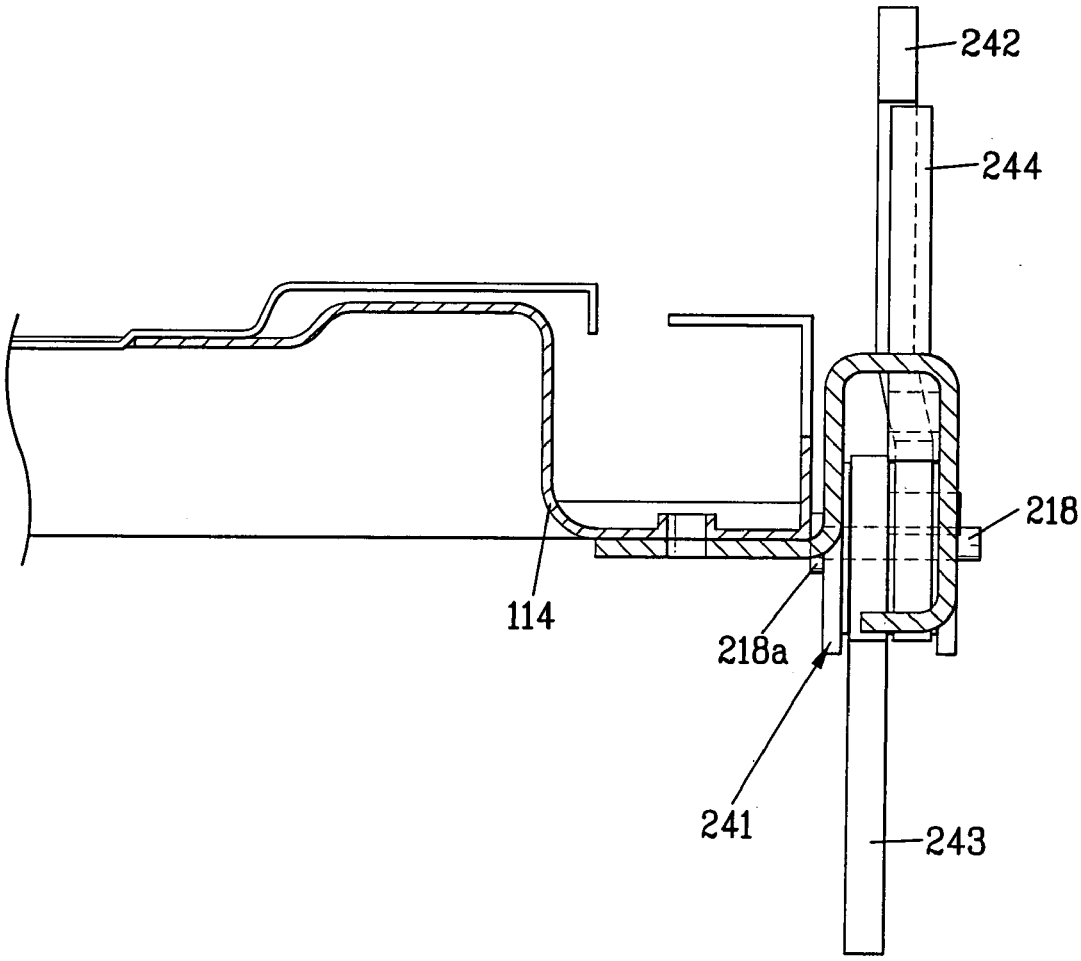
FIG. 17 illustrates a section of a latch assembly in accordance with a preferred embodiment of the present invention.

A fitting structure of the latch of the present invention will be described. FIG. 16 illustrates a side view of a latch assembly in accordance with a preferred embodiment of the present invention, and FIG. 17 illustrates a section of the fitting structure.

Referring to FIG. 16, the latch assembly includes a door panel 241, a push bar 244, a latch 242, a handle 243, a spring 306, and a fastening pin 218. The door panel 241 is provided to one side of the door. The push bar 244 is in an upper part of the door panel 241, and the latch 242 is in a lower part of the door panel 241. The handle 243 has one end connected to the latch 242.

The spring 306 has one end connected to an upper part of the door panel 241, and the other end connected to a hook 242*a* on the latch 242, so that the spring 306 provides a restoring force for rotating the latch 242 in a counter clockwise direction.

The latch 242 has an extension 242*c* in a lower part, and the door panel 241 has a projection 241*a* formed thereon. Since the extension 242*c* is held by the projection 241*a* at a desired angle, any further rotation of the latch 242 is prevented.

In the meantime, the fastening pin 218 is fastened to the door panel, passing through the door handle 243 and the latch 242. According to this, the door handle 243 and the latch 242 turn around the fastening pin 218.

The latch 242 and a link part 203 of the handle 243 are on the same rotation shaft, so that the handle 243 and the latch 242 rotate together.

Referring to FIG. 16, when the handle 243 is rotated in a clockwise direction for opening the door, the latch 242 also rotates in a clockwise direction. In this instance, the hook 242*b* at the end of the latch 242 is disengaged from the projection (reference numeral 201*a* in FIG. 7).

Opposite to this, what is required for closing the door is just pushing the door forward in a state the handle 243 is at a regular position. In this instance, the latch 242 is inserted into the door panel 241, and engaged with the projection 241*a*.

Referring to FIG. 17, the fastening pin 218 is fitted such that a head 218*a* thereof is clamped between the door panel 241 and the door 114, and the other end directed to an open surface of the door panel 241. The door panel 241 is fastened to one side of the door 114 rigidly with screws or the like.

Thus, since the head 218*a* of the fastening pin is clamped between the door panel 241 and the door 114, break away of the fastening pin 218 is prevented.

As has been described, the microwave oven of the present invention has the following advantages.

First, the restoration of the levers fitted to the door for the microwave oven of the present invention by gravity permits to dispense with springs, to reduce a number of required components.

Second, the fastening of the switches to the latch board only with screws simply without the hook permits to simplify the switch fastening structure.

Third, the formation of at least three arms on the lever such that one lever can operate at least two switches permits to simplify a lever fitting structure.

Fourth, the formation of the pin, serving as a rotation shaft of the door, as one unit with the door permits to simplify an assembly process. Moreover, breakage of the pin taken place when the pin is formed separately can be prevented.

Fifth, the employment of the fastening pin instead of bolt-nut as an operational rotation shaft of the latch and the door handle permits to simplify assembly, and prevents break away of the operational rotation shaft.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A door assembly for a microwave oven, comprising:

a door panel having a push bar and a latch each extending from one side of the door panel toward a body portion of a microwave oven; and a latch board positioned opposite the push bar and the latch, comprising:

a plurality of levers each rotatably fitted to the latch board and positioned so as to contact the latch or the push bar; and a plurality of switches each configured to be actuated upon contact with a corresponding lever, wherein at least one of the plurality of levers is in contact with at least two switches of the plurality of switches.

2. The door assembly as claimed in claim 1, wherein at least one of the plurality of levers has at least three arms.

3. The door assembly as claimed in claim 1, wherein the plurality of levers includes a first lever configured to contact the push bar, and a second lever configured to contact the latch.

4. The door assembly as claimed in claim 3, wherein the second lever includes a first arm and a second arm configured to actuate corresponding switches when a third arm of the second lever which is configured to contact the latch is pushed and rotated by the latch.

5. The door assembly as claimed in claim 3, wherein the first lever includes a first arm configured to actuate a corresponding switch when a second arm of the first lever which is configured to contact the push bar is pushed and rotated by the push bar.

6. The door assembly as claimed in claim 1, wherein the door panel is formed as a single unit with a door of the microwave oven.

7. The door assembly as claimed in claim 1, wherein the latch board includes a push bar hole and a latch hole configured to receive the push bar and the latch, respectively, therein.

8. The door assembly as claimed in claim 7, wherein an end portion of the latch comprises a sloped surface such that the sloped surface slides into the latch hole as the latch is inserted into the latch hole.

9. The door assembly as claimed in claim 7, wherein the latch hole includes a projection provided on an inside edge thereof which is configured to engage the latch.

10. The door assembly as claimed in claim 9, wherein an upper side of the projection is configured to support an arm of the corresponding lever which contacts the latch when the latch is not inserted in the latch hole.

11. The door assembly as claimed in claim 1, further comprising a spring with a first end coupled to a hook at one end of the latch, and a second end coupled to an upper part of the door panel.

12. The door assembly as claimed in claim 11, wherein the latch is configured to rotate in response to a restoring force provided by the spring so as to push an arm of the corresponding lever, wherein an arm of the corresponding lever contacts the latch.

13. The door assembly as claimed in claim 1, wherein the plurality of switches are fitted at corresponding positions on a front surface and a rear surface of the latch board.

14. The door assembly as claimed in claim 1, wherein each of the plurality of switches has holes configured to receive a corresponding fastening pin and boss provided on the latch board so as to fasten the plurality of switches to the latch board with a screw fastened to each boss.

15. The door assembly as claimed in claim 1, wherein the plurality of levers each rotate to an original position when the levers are disengaged from the latch or the push bar.

16. The door assembly as claimed in claim 15, wherein the latch board has at least one stopper configured to hold at least one of the plurality of levers at respective preset positions.

17. The door assembly as claimed in claim 1, wherein each of the plurality of levers is coupled to a corresponding rotation shaft which projects from the latch board and is held in place on the corresponding rotation shaft by a hook.

18. The door assembly as claimed in claim 17, wherein each of the plurality of levers has a sloped surface at a portion thereof which contacts the hook when the lever is coupled to the rotation shaft.

19. A door assembly for a microwave oven comprising:

a door panel provided at one side of a door of a microwave oven, the door panel having a push bar and a latch each extending from one side thereof toward a body portion of the microwave oven; and a latch board comprising:

a plurality of levers each rotatably coupled to the latch board so as to contact the latch or the push bar;

a board wall configured to divide a front surface and a rear surface of the latch board; and a plurality of switches provided at corresponding positions on the front and rear surfaces of the board wall.

20. The door assembly as claimed in claim 19, wherein the board wall has pass through holes formed therein, and each of the plurality of levers has an extension portion configured to extend through a corresponding the pass through holes and move along a patch formed by the corresponding pass through hole.

21. The door assembly as claimed in claim 20, wherein the plurality of levers are configured to operate corresponding switches positioned on the front surface of the board wall, and the extension portions are configured to operate corresponding switches positioned on the rear surface of the board wall.

22. The door assembly as claimed in claim 19, wherein the plurality of switches includes a pair of first safety switches, a pair of second safety witches, and a pair of monitor switches, and wherein individual switches of the pairs of switches are positioned parallel to one another on opposite sides of the board wall.

23. A door assembly for a microwave oven, comprising:

horizontal members extending from at least one of an upper edge and a lower edge of a door of a microwave oven;

at least one pin formed as a single unit with one of the horizontal members; and brackets provided on a frame of the microwave oven in a position corresponding to the at least one pin, and each having a hole configured to receive the at least one pin.

24. The door assembly as claimed in claim 23, wherein the at least one pin comprises a projection from one of the horizontal members which is formed by pressing.

25. The door assembly as claimed in claim 23, wherein the horizontal members are formed as a single unit with the door.

26. A door assembly for a microwave oven, comprising:

a latch assembly, including:

a door panel provided at one side of a door of a microwave oven;

a push bar which extends from the door panel toward a body portion of the microwave oven;

a latch rotatably coupled to the door panel at a predetermined distance from the push bar;

a spring with a first end coupled to an upper part of the door panel, and a second end coupled to the latch; and a fastening pin fastened through the door panel and the latch so as to serve as a rotation shaft for the latch; and a latch board including a plurality of levers configured to rotate based on contact with the latch or the push bar, and switches configured to operate based on contact with one of the plurality of levers.

27. The door assembly as claimed in claim 26, further comprising a handle linked to the latch and rotatably coupled to the fastening pin.

28. The door assembly as claimed in claim 26, wherein the fastening pin has a head portion disposed between the door and the door panel.

29. The door assembly as claimed in claim 26, wherein the spring is configured to provide a restoring force to rotate the latch in one direction.

30. The door assembly as claimed in claim 26, further comprising a projection provided on one side part of the door panel and configured to engage the latch such that the latch rotates no more than a predetermined angle.

* * * * *